US005417325A

United States Patent [19]

Kunreuther

[11] Patent Number: 5,417,325

[45] **Date of Patent: * May 23, 1995**

[54] CLIP OF ATTACHMENTS

[76] Inventor: Steven Kunreuther, 285 Central Park West, New York, N.Y. 10024

[ * ] Notice: The portion of the term of this patent subsequent to Aug. 23, 2011 has been disclaimed.

[21] Appl. No.: 261,925

[22] Filed: Jun. 17, 1994

Related U.S. Application Data

[62] Division of Ser. No. 10,836, Jan. 27, 1993, Pat. No. 5,339,954, and Ser. No. 194,996, Feb. 14, 1994, which is a division of Ser. No. 10,836, Feb. 14, 1994.

[51] Int. Cl.[6] ..... A44B 9/00; B65D 85/24; G09F 3/12

[52] U.S. Cl. ..... 206/346; 206/343; 24/711.1; 40/662

[58] Field of Search ..... 206/343, 344, 345, 346, 206/347, 348, 820, 380; 24/711.1; 40/662, 664

[56] References Cited

U.S. PATENT DOCUMENTS

| | | | |
|---|---|---|---|
| 3,103,666 | 9/1963 | Bone . | |
| 3,444,597 | 5/1969 | Bone . | |
| 3,733,657 | 5/1973 | Lankton . | |
| 3,888,402 | 6/1975 | Bone . | |
| 3,895,753 | 7/1975 | Bone . | |
| 4,347,932 | 9/1982 | Furutu . | |
| 4,416,407 | 11/1983 | Bone . | |
| 4,417,656 | 11/1983 | Kato . | |
| 4,461,417 | 7/1989 | Furutsu . | |
| 5,038,931 | 8/1991 | Kunreuther . | |
| 5,339,954 | 8/1994 | Kunreuther | 206/346 |

FOREIGN PATENT DOCUMENTS

| | | |
|---|---|---|
| 2647753 | 4/1978 | Germany . |
| 2058857 | 4/1981 | United Kingdom . |
| 2199530 | 7/1988 | United Kingdom . |
| WO8704554 | 7/1987 | WIPO . |

*Primary Examiner*—Steven N. Meyers
*Assistant Examiner*—Ted Kavanaugh
*Attorney, Agent, or Firm*—James & Franklin; Harold James; Robert L. Epstein

[57] ABSTRACT

One or both ends of the connector bar is extended outwardly beyond the main section of the bar to which the attachments are mounted. The extended end provides access to the clip from the exterior of the attacher housing, permitting the clip to be manually advanced if the feed mechanism fails. An element may be situated on one extended end to facilitate grasping. In a clip having two connector bars, the ends of both bars extend in the same direction. The extended ends may be bent towards each other and may be connected to form a bridge. A second aspect of the invention relates to a connector bar which has an element designed to cooperate with the housing to prevent advancement of the clip all the way through the housing channel, thereby requiring the operator to remove the empty connector bar from the device for better control of disposal.

4 Claims, 5 Drawing Sheets

FIG. 3
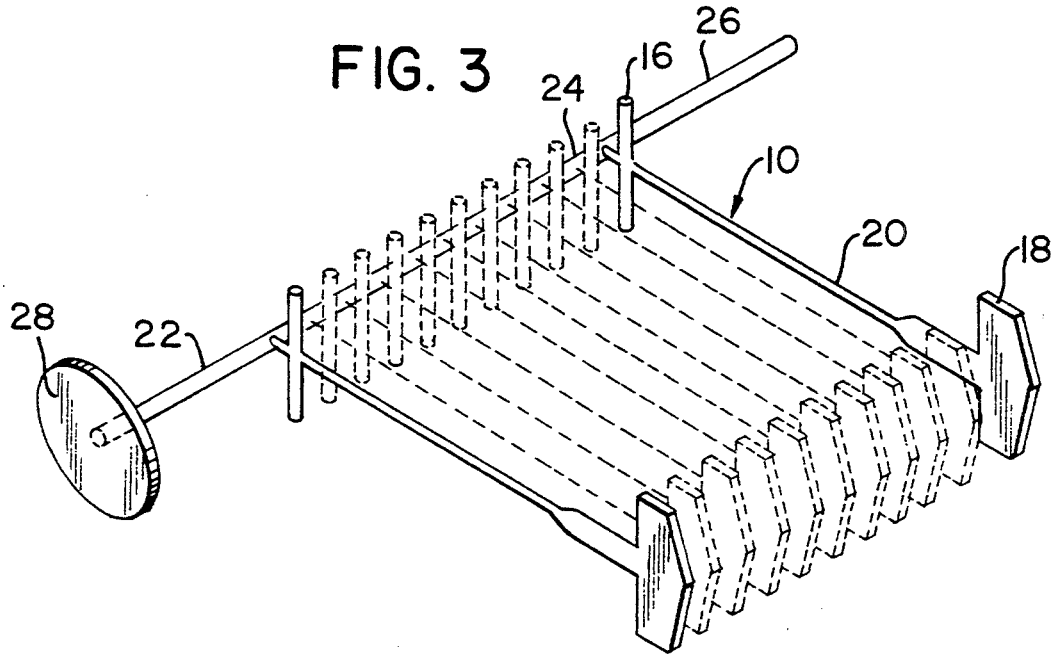
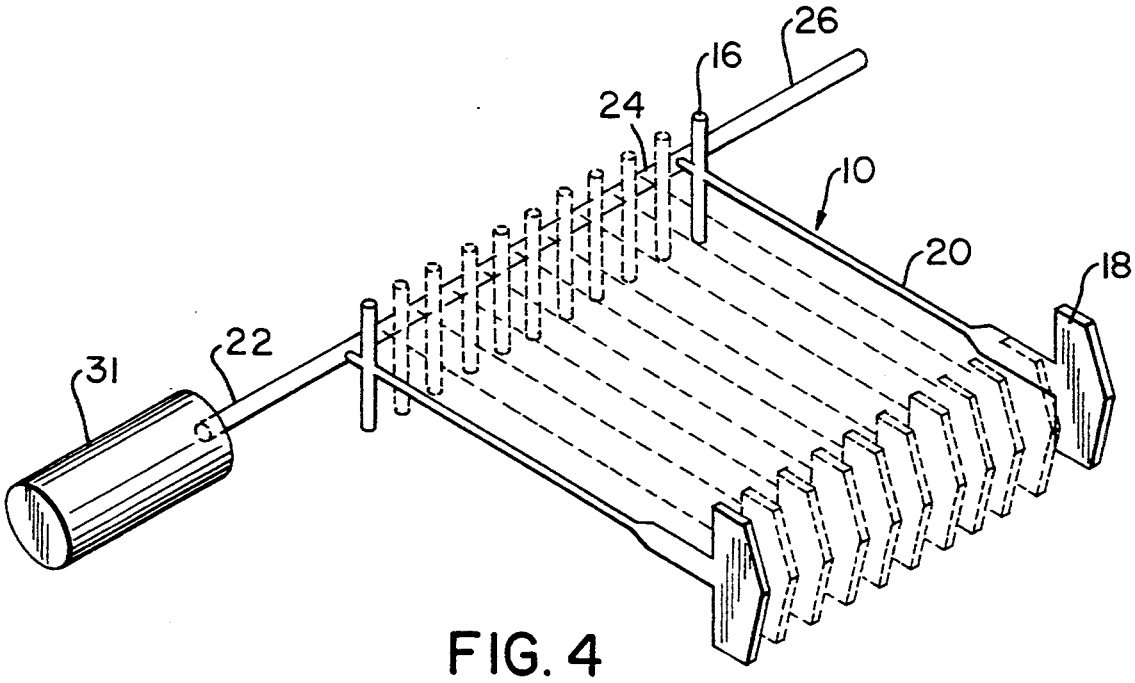
FIG. 4

CLIP OF ATTACHMENTS

This is a divisional of application Ser. No. 08/010,836 filed on Jan. 27, 1993, now U.S. Pat. No. 5,339,954 and of Application Ser. No. 08/194,996 filed on Feb. 14, 1994, a divisional thereof.

The present invention relates in general to plastic attachments or fasteners commonly used to attach tags to soft goods such as clothing. These attachments are commonly manufactured in clips consisting of a plurality of parallel, side by side attachments extending from a connector bar. The attachments are designed to be dispersed, one at a time, through the hollow needle of a tag attaching device. More particular the invention relates to an improved clip structure in which a part of the connector bar remains accessible from the exterior of the housing of the attaching device to permit the clip to be manually advanced along the housing channel. A second aspect of the invention relates to a connector bar designed to limit the advancement of the clip through the device housing channel to permit better control of the disposal of empty connector bars.

Injection molded, heat stretched attachments including a "T" bar end and a second end (either an enlarged "paddle" of one of several different shapes or a second "T" bar) are widely known in the art. They have been commercially available from several sources for many years.

Variations on one type (nonconnected paddle) of such attachments are disclosed in U.S. Pat. No. 3,103,666 to Arnold Bone, U.S. Pat. No. 3,444,597 to Arnold Bone and U.S. Pat. No. 4,347,932 to Akira Furutsu. A so-called "connected paddle" version is disclosed in U.S. Pat. No. 3,733,657 to Gordon Lankton. In both versions, the attachments are connected in parallel, spaced relation along a single connector bar to form clips of 50 or 100 attachments each. These single connector bar type clips are designed to be dispensed with manual and automatic tag attaching devices also well known in the art. Examples are disclosed in U.S. Pat. No. 3,895,753 to Arnold Bone, U.S. Pat. No. 3,888,402 to Arnold Bone and U.S. Pat. No. 4,416,407 to Arnold Bone.

Clips of attachments can also be formed by mounting the attachments between two spaced, parallel connector bars. The double connector bar clips are disclosed in my U.S. Pat. No. 5,038,931. That patent also discloses a device for dispensing attachments supplied in double connector bar clips.

Attaching devices for these types of attachments include mechanisms which automatically advance the clip such that the attachments, one at a time, are brought into alignment with the hollow dispensing needle. The feed mechanism is actuated by the depression of a trigger, either manually or by a solenoid or motor, if electrically driven or by air pressure if pneumatically driven. The feed mechanisms commonly include indexing wheels or pivotally mounted fingers which engage the clip and move relative to the housing in a manner which causes the clip to advance a short distance each time the mechanism is actuated.

All feed mechanisms, particularly those of complicated design with many of molded plastic parts, have a tendency to wear and occasionally will not function properly. The purpose of one aspect of my invention is to provide auxiliary means, accessible from the exterior of the device housing regardless of the position of the clip, for permitting manual advancement of the clip through the housing. With this means, the operator has access to the clip so that it can be advanced even if the feed mechanism is not operating properly. This feature is particularly useful with devices which employ clips with double connector bars where the feed mechanism tends to be very complicated.

A second aspect of my invention relates to the control of the disposal of connector bars, after all the attachments on the clip have been dispensed. Normally, once the last attachment has been dispensed, the connector bar passes through the housing channel and out the bottom of the device, onto the factory floor. The empty connector bars collect on the floor and represent a potential safety hazard. In my invention, the connector bar is fashioned so that it cannot pass entirely through the channel. Instead, the bar can advance only to a certain point. Thus, to remove an empty connector bar, the bar must be grasped manually, moved in a direction opposite the direction of normal advancement and then removed then from the top of the device. Because the bars must be grasped to be removed, operators can be trained to drop the empty bars into a disposal receptacle provided for this purpose, before a new clip is inserted into the device.

It is, therefore, a prime object of the present invention to provide a clip of attachments which is capable of being manually manipulated from the exterior of the device housing regardless of the position of the clip, so that the clip can be advanced along the housing channel in the event that the feed mechanism is not functioning.

It is another object of the present invention to provide a clip of attachments with a connector bar which will not pass through and out of the device after all of the attachments have been dispensed, but instead must be manually removed from the device housing so as to facilitate control of disposal.

In accordance with one aspect of the present invention, a clip of attachments is provided comprising a plurality of attachments connected in spaced, substantially parallel relation along the main section of a connector bar. Each of the attachments includes a "T" bar end and a second end. The ends are connected by a filament. The connector bar has a part which extends beyond the main section of the connector bar.

The other end of the connector bar may also have a part which extends beyond the main section of the connector bar.

Grasping means may be mounted on the extended part. The grasping means may comprise an element extending in a plane substantially perpendicular to the connector bar part. The grasping means may include a substantially disc-like element or a substantially cylindrical element.

The second attachment end preferably also comprises a "T" bar. When attachments with two "T" bar ends are used, a second connector bar may also be provided. The second connector bar also has a main section to which the attachments are connected. At least one end of the second connector bar has a part which extends beyond the main portion of the second connector bar. Preferably, the extended parts from both connecting bars extend in the same direction.

Grasping means preferably extend from the extended parts. The grasping means may comprise sections of the extended parts directed inwardly toward each other. Means for joining the sections may be provided. The joining means may comprise an enlarged element. The sections may form a continuous bridge between the connector bars.

The clip is adapted for use with apparatus for dispensing and attaching attachments through a hollow needle mounted on a housing. The housing has a channel along which the connector bar is advanced, as each attachment is moved into alignment with the needle so that it can be dispensed. The extending part extends beyond the main section of the connector bar, a distance at least equal to the distance between the plane of the needle and the exterior surface of the housing proximate the channel entrance.

Preferably, the part extends beyond the main section of the connector bar at least a distance greater than twice the spacing between the attachments.

In accordance with another aspect of the present invention, a clip of attachments is provided including a plurality of attachments situated in spaced, substantially parallel relation along a connector bar. Each of the attachments includes a "T" bar end and a second end. The ends are connected by a filament. The clip is adapted for use with apparatus for dispensing attachment, through a hollow needle mounted on a housing. The housing has a channel along which the connector bar is advanced as attachments are dispensed. The connector bar comprises means for cooperating with the housing to limit advancement of the connector bar beyond a given point along the channel.

The channel has an opening adapted to receive the connector bar. The channel opening has a given dimension. The cooperating means includes a part on the connector bar having a dimension greater than the given dimension of the channel opening.

Preferably, the cooperating means comprises an element extending from the connector bar in a direction other than the direction of the axis of the connector bar.

To these and such other objects which may hereinafter appear, the present invention relates to an improved clip of attachments as set forth in detail in the following specification and recited in the annexed claims, taken together with the annexed drawings, wherein like numerals relate to like parts:

FIG. 3 is an isometric view of a first variation on the first preferred embodiment of the present invention;

FIG. 4 is an isometric view of a second variation on the first preferred embodiment of the present invention;

The drawings depict the clips of attachments in idealize form. Moreover, the drawings are not to scale. They are intended for illustrative purposes only.

Figure 1:
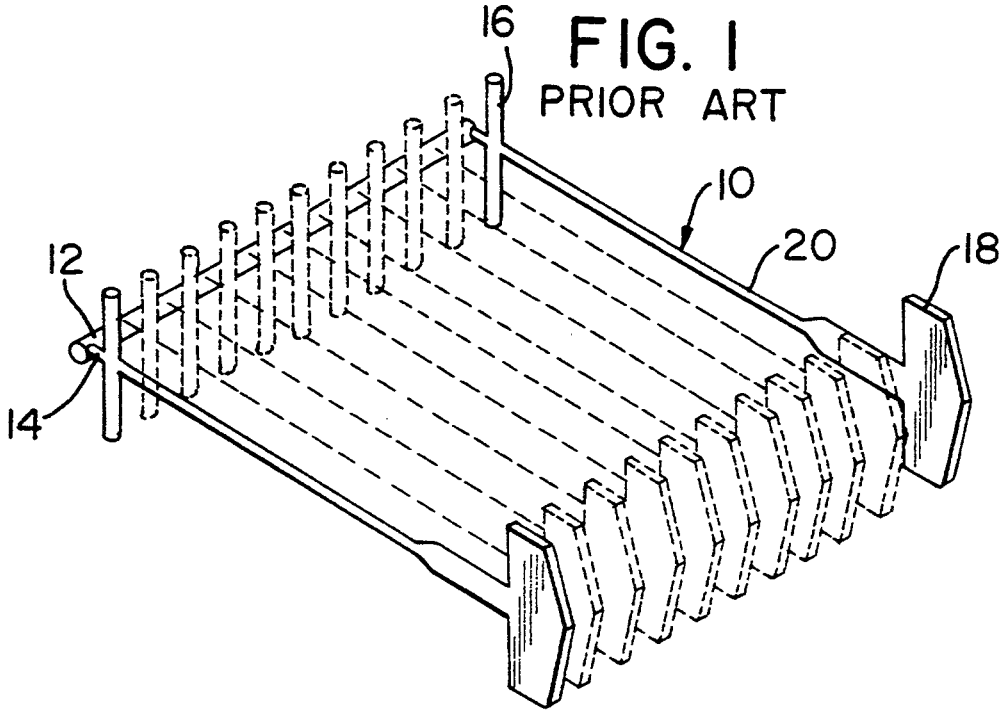
FIG. 1 PRIOR ART
FIG. 1 is an isometric view of a conventional clip of non-attached paddle attachments.

As seen in FIG. 1, a conventional clip of nonconnected paddle attachments on a single connector bar, includes a plurality of injection molded plastic attachments, generally designated 10, connected in spaced, substantially parallel relation along connector bar 12 by a plurality of elements 14.

Each attachment 10 includes a "T" bar end 16. The "T" bars have a generally cylindrical shape and are adapted to pass through the passage in a hollow needle mounted on a conventional tag attaching device. Each "T" bar end 16 is connected to a second end 18 which, in this illustration, is shown as an enlarged paddle of anchor shape. However, paddles of rectangular, round and oval shapes are also commonly used. Ends 16 and 18 are connected by a very thin filament 20 which is heated and stretched to increase its strength.

It should be noted that in prior art clips, such as the one shown in FIG. 1, connector bar 12 is only as long as the width of the group of attachments 10 connected to it by elements 14. That is, the first and last elements 14 are in planes proximate the planes in which the extreme opposite ends of the connector bar 12 lie. This configuration is usually considered to be desirable because it minimizes the amount of plastic material required and reduces tangling of connector bars of one clip with other clips. In many clips, a nub or small protrusion may exist on the end of the connector bar beyond the plane of the end attachment to insure proper joining of the end attachment to the bar. However, this nub is generally smaller than the distance between attachments and therefore cannot serve the function for which the present invention is intended.

Figure 2:
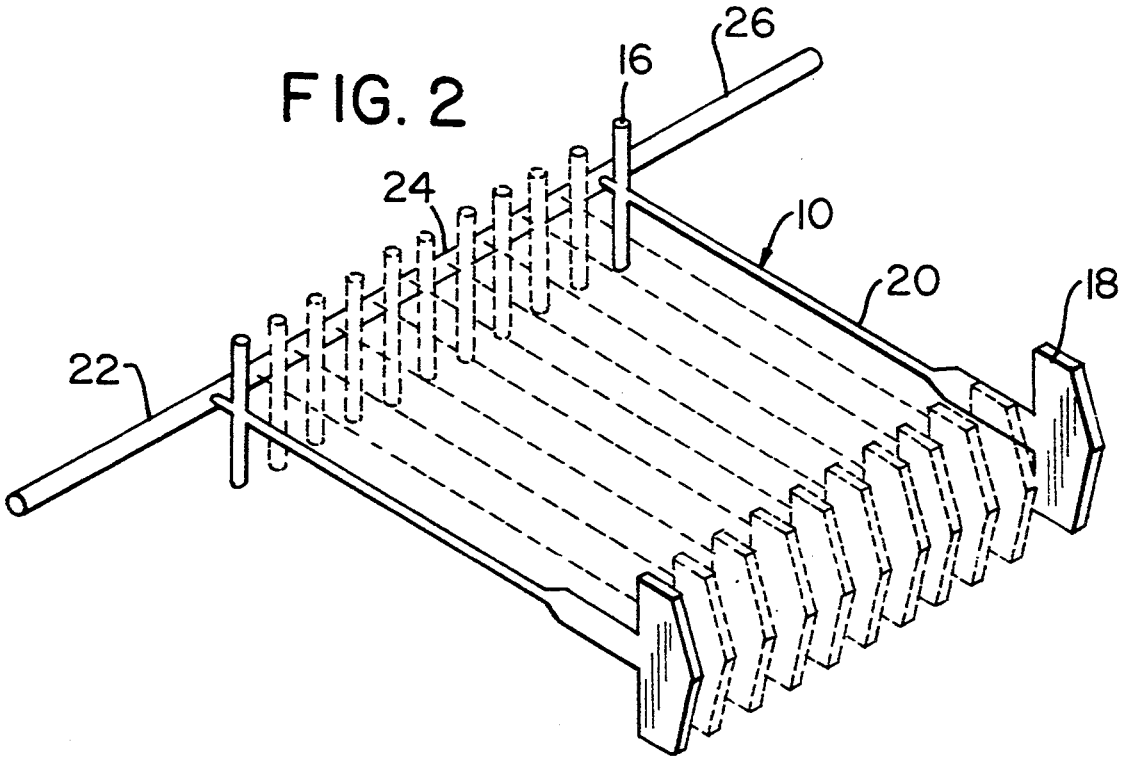
FIG. 2 is an isometric view of a first preferred embodiment of the present invention.

FIG. 2 illustrates one preferred embodiment of my invention. Here connector bar 12 is provided with a part 22 which extends beyond the main section 24 of the connector bar to which attachments 10 are connected. Part 22 extends along the axis of bar 12 in one direction. A second part 26 may also be provided. Part 26 also extends along the axis of bar 12, but in an opposite direction from part 22. Thus, regardless of which end of the clip is inserted into the attacher, one of the extending parts will always be accessible from the top of the housing.

FIG. 3 illustrates a first version of the first preferred embodiment. As shown in FIG. 3, a disk-like element 28 is provided at the end of part 22. Element 28 preferably has a planar surface 30 which extends in a direction perpendicular to the axis of bar 24. Element 28 acts to facilitate grasping of the connector bar so that the clip can more easily be moved manually relative to the housing.

FIG. 4 illustrates another variation of the first preferred embodiment. In this version, element 28 is replaced by an element 31 having a substantially cylindrical shape. Element 31 also facilitates grasping.

Figure 5:
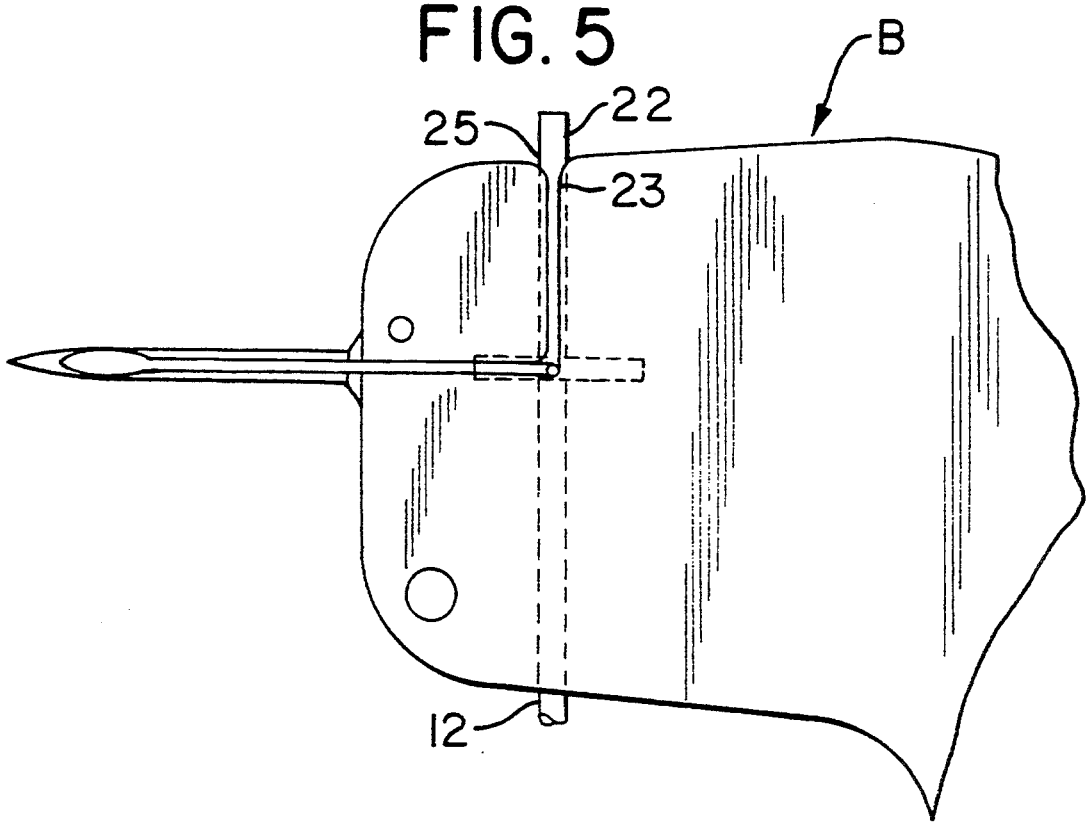
FIG. 5 is a cutaway view of a portion of a typical attaching device with a clip according to the first preferred embodiment of the present invention.

FIG. 5 shows the side of the housing of a tag attaching device, generally designated B. A channel 23 with an opening or mouth 25 is illustrated. Channel 23 has a portion shaped to accept connector bar 24. It will be appreciated that part 22 of connector bar 24 extends sufficiently beyond the exterior surface of the housing so as to be accessible from the exterior of the device, even when the T bar 16 of the last attachment 10 is aligned with the needle 27 as shown in FIG. 5. The length of part 22 is selected such that part 22 is always accessible from the exterior of the housing, regardless of the position of the bar in the channel.

Figure 6:
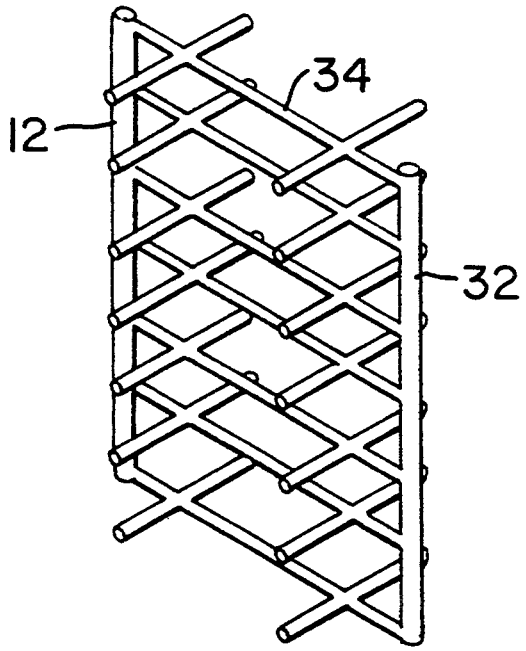
FIG. 6 PRIOR ART
FIG. 6 is an isometric view of a conventional clip of attachments with two connector bars.

FIG. 6 illustrates a conventional clip of attachments with two connector bars. This clip consists of two parallel connector bars 12 and 32 between which a plurality of attachments 34 are mounted. Attachments 34 have "T" bars at both ends.

Figure 7:
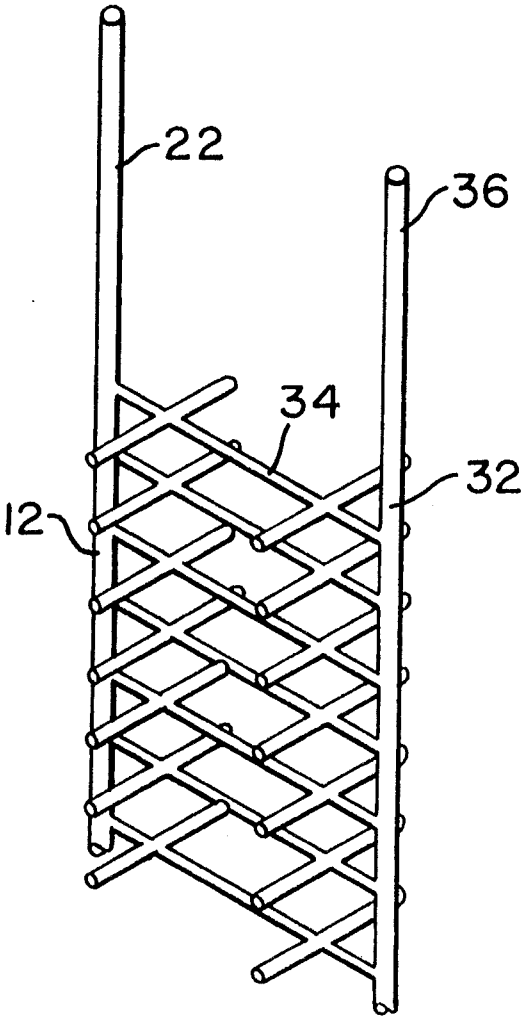
FIG. 7 is an isometric view of a second preferred embodiment of the present invention.

FIG. 7 illustrates a clip with two connector bars modified in accordance with the present invention by providing parts 22 and 36 respectively extending beyond the main sections of bars 12 and 32. Preferably parts 22 and 36 extend in the same direction.

When the clip of FIG. 7 is received in an attacher designed for this purpose, both parts 22 and 36 will always be accessible from the exterior of the housing. The clip can then be manually advanced through the device in a balanced manner, in the event that the feed mechanism is not functioning.

Figure 8:
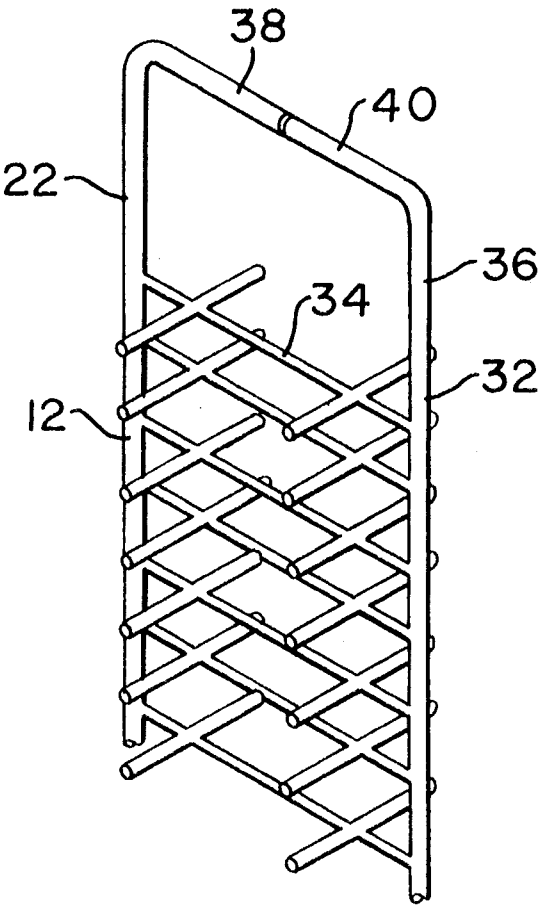
FIG. 8 is an isometric view of a first variation of the second preferred embodiment of the present invention.

FIG. 8 shows a second variation of the second preferred embodiment. In this version, parts 22 and 36 are further elongated and have portions 38, 40 which extend inwardly toward each other. However, a small gap remains between the extended portions.

Figure 9:
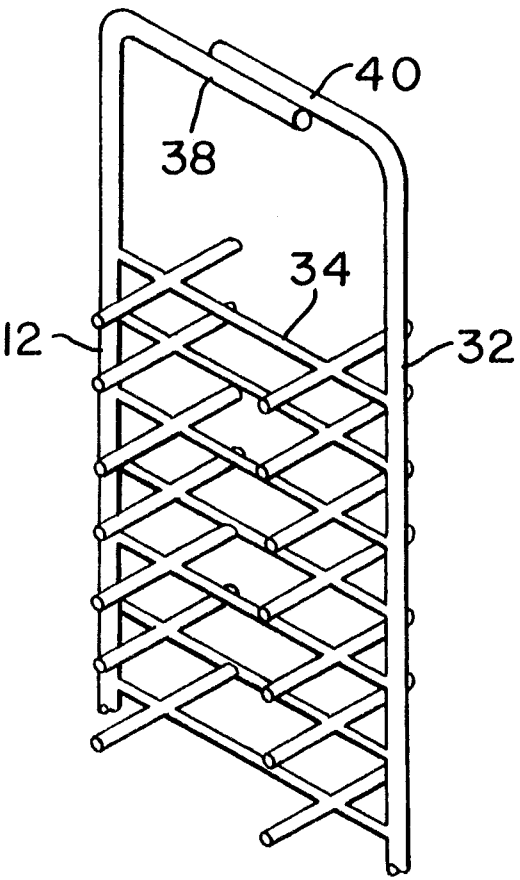
FIG. 9 is an isometric view of a second variation of the second preferred embodiment of the present invention.

FIG. 9 shows a third variation of the second preferred embodiment. In this version, portions 38 and 40 are elongated to an even greater degree so that they overlap.

Figure 10:
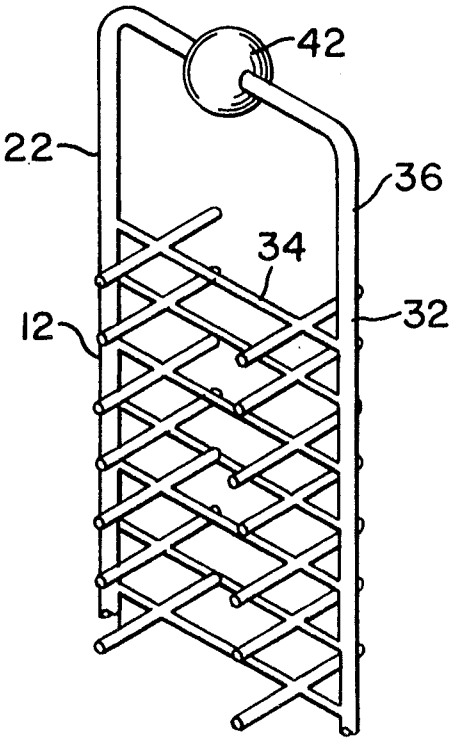
FIG. 10 is an isometric view of a third variation of the second preferred embodiment of the present invention.

FIG. 10 shows another variation of the second preferred embodiment. In this version, portions 38 and 40 are connected by an enlarged portion 42.

Figure 11:
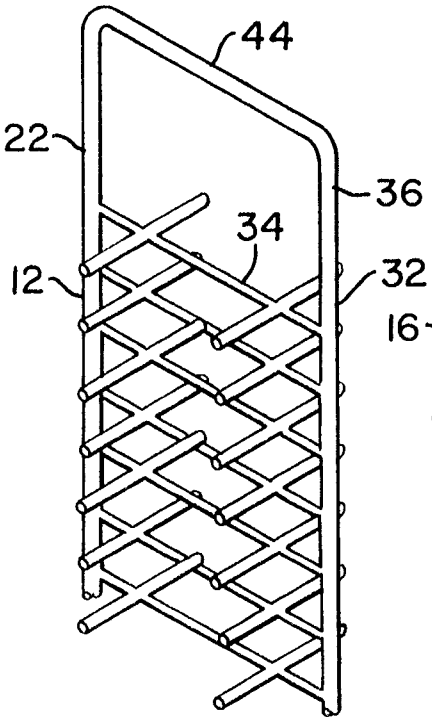
FIG. 11 is an isometric view of a third preferred embodiment of the present invention.

FIG. 11 shows still another variation. In this case, enlarged portion 42 is absent but portions 38 and 40 are connected to form a continuous bridge 44 of substantially uniform thickness.

Figure 12:
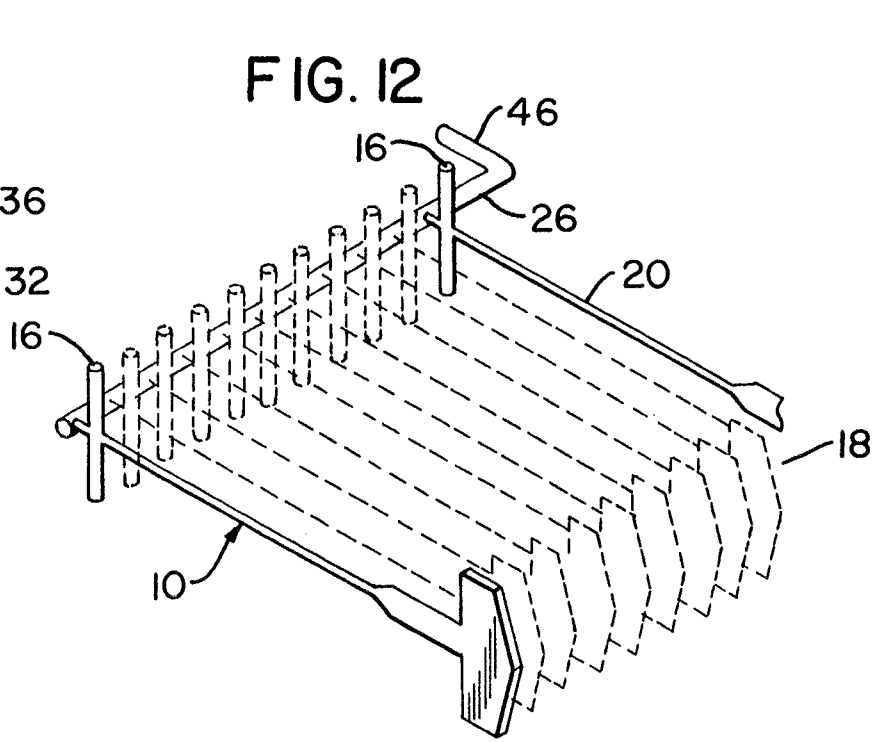
FIG. 12 is an isometric view of the third preferred embodiment of the present invention.

FIG. 12 illustrates a third preferred embodiment of the present invention. In this embodiment, a bent or enlarged element 46 is provided at the extended part 26 of the connector bar 24. Element 46 extends in a direction other than the axis of connector bar 24 and is larger than the mouth or opening 25 of the channel 23 through which the connector bar advances. Element 46 is situated such that it will contact the housing surface adjacent the mouth 25 of the channel 23 after the last attachment has been dispensed. The purpose of element 46 is to prevent the connector bar 12 from passing all the way through the channel 23 and out the bottom of the device. In order to remove the empty connector bar 24 from the device, it must be grasped by the operator and pulled out of the channel. Once it is grasped by the operator, it is more easily properly discarded. Element 46 can be of any shape desired or may simply be a bent portion of the part.

It should now be appreciated that the present invention relates to improvements in clips of plastic attachments both of the single and double connector bar types. In one embodiment, single connector bars are extended to facilitate access from the exterior of the housing. In the second embodiment, double connector bars are extended and in some versions, form a connecting bridge. In the third embodiment, an element is used to limit advancement of the clip, thereby enhancing control over the manner in which empty connector bars are discarded.

While only a limited number of preferred embodiments have been disclosed for purposes of illustration, it is obvious that many variations and modifications could be made thereto. It is intended to cover all of these variations and modifications which fall within the scope of the present invention, as defined by the following claims:

I claim:

1. A clip of attachments comprising a plurality of attachments and first and second connecting bars each having a main section and an end, said attachments being connecting in spaced, substantially parallel relation between said main sections of said connecting bars, each of said attachments comprising a first and second "T" bar ends, said ends being connecting by a filament, said ends of said connecting bars each comprising a part extending for a substantial distance outwardly beyond said main section, in substantially the same direction, and grasping means, said grasping means extending from said extended parts and comprising portions of said extended parts directed inwardly towards each other.

2. The clip of claim 1 further comprising means for joining said portions.

3. The clip of claim 2 wherein said joining means comprises an enlarged section.

4. The clip of claim 1 wherein said portions form a continuous bridge between said connector bars.

* * * * *